US012435604B2

(12) United States Patent
Glaesman et al.

(10) Patent No.: US 12,435,604 B2
(45) Date of Patent: Oct. 7, 2025

(54) FLUOROPLASTIC EXPANDABLE LINER HANGER ELEMENTS FOR GEOTHERMAL AND CORROSIVE ENVIRONMENTS

(71) Applicant: Halliburton Energy Services, Inc., Houston, TX (US)

(72) Inventors: Chad W. Glaesman, Singapore (SG); Sandeep Thatathil, Singapore (SG)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/590,535

(22) Filed: Feb. 28, 2024

(65) Prior Publication Data

US 2025/0270903 A1 Aug. 28, 2025

(51) Int. Cl.
*E21B 43/10* (2006.01)
*E21B 33/05* (2006.01)
*E21B 33/12* (2006.01)

(52) U.S. Cl.
CPC ..... *E21B 43/108* (2013.01); *E21B 33/05* (2013.01); *E21B 33/1208* (2013.01)

(58) Field of Classification Search
CPC ..... E21B 43/108; E21B 33/05; E21B 33/1208
See application file for complete search history.

(56) References Cited

U.S. PATENT DOCUMENTS

| | | | | |
|---|---|---|---|---|
| 6,907,937 | B2 * | 6/2005 | Whanger | E21B 43/103 166/387 |
| 6,921,088 | B2 | 7/2005 | Lineton | |
| 9,447,662 | B2 * | 9/2016 | Johnson | E21B 33/1208 |
| 10,012,052 | B2 * | 7/2018 | Bergland | E21B 47/12 |
| 10,961,804 | B1 * | 3/2021 | Fripp | E21B 33/1208 |
| 11,118,434 | B2 * | 9/2021 | Hazelip | E21B 23/01 |
| 11,519,239 | B2 * | 12/2022 | Greci | E21B 17/206 |
| 2005/0011650 | A1 | 1/2005 | Harrall et al. | |
| 2008/0185144 | A1 * | 8/2008 | Lovell | E21B 43/10 166/66 |
| 2009/0090516 | A1 | 4/2009 | DeLucia et al. | |
| 2016/0053591 | A1 | 2/2016 | Hallundbaek et al. | |
| 2020/0370383 | A1 * | 11/2020 | Hazelip | E21B 43/105 |
| 2020/0378220 | A1 | 12/2020 | Hazelip | |
| 2021/0189830 | A1 * | 6/2021 | Greci | E21B 43/103 |
| 2023/0340854 | A1 | 10/2023 | Fripp et al. | |

FOREIGN PATENT DOCUMENTS

| | | | |
|---|---|---|---|
| CA | 2840140 A1 * | 12/2012 | E21B 33/12 |
| CN | 100564474 | 12/2009 | |
| EP | 3638932 | 2/2022 | |

OTHER PUBLICATIONS

"PCT Application No. PCT/US2024/017782 International Search Report and Written Opinion", Nov. 21, 2024, 10 pages.
"Parker PTFE Lip Seal Design Guide Catalog EPD 5340/USA", Parker Hannifin Corporation EPS Division, Jan. 15, 2006, 170 pages.

* cited by examiner

*Primary Examiner* — Aaron L Lembo
(74) *Attorney, Agent, or Firm* — DeLizio, Peacock, Lewin & Guerra LLP

(57) ABSTRACT

Some implementations include a system comprising a radially expandable sealing device positioned in a wellbore proximate to a subsurface formation and one or more fluoroplastic sealing elements positioned on an exterior of the radially expandable sealing device.

20 Claims, 5 Drawing Sheets

300

| Property | Method No. | Units | PTFE | FEP | PFA | ETFE | ECTFE | PCTFE | PVDF |
|---|---|---|---|---|---|---|---|---|---|
| Specific Gravity | D792 | - | 2.17 | 2.15 | 2.15 | 1.74 | 1.7 | 1.7 | 1.78 |
| Melting Point | D2236 | deg F | 621 | 518 | 581 | 527 | 464 | 410 | 352 |
| | | deg C | 327 | 270 | 305 | 275 | 240 | 210 | 177 |
| Tensile Strength | D638<br>D1708<br>D1457 | psi<br>MPa | 2500<br>17 | 3400<br>23 | 4,000<br>27 | 6,960<br>48 | 6,960<br>48 | 6,060<br>41.78 | 7,830<br>54 |
| Yield Strength | D638 | psi | 1,450 | 1,740 | 2,250 | 3,480 | 4,500 | 5,800 | 6,670 |
| Elongation | | % | 200-500 | 250-350 | 300 | 200-500 | 200-300 | 80-250 | 20-150 |
| Tensile Modulus | D638 | ksi | 87 | 72.5 | 101.5 | 217.5 | 240 | 218 | 348 |
| Flex Modulus | D790 | psi x 1000 | 98 | 101.5 | 95 | 203 | 261 | - | 333.5 |
| | | MPa | 675 | 700 | 655 | 1400 | 1800 | | 2300 |
| Izod Impact | D256 | ft-lbs/in | 3.2 | No Break | No Break | No Break | - | - | 2-4 |
| | | J/m | 173 | | | | | | |
| Hardness | D2240 | Shore D | 60 | 57 | 62 | 75 | 75 | 90 | 79 |
| HDT, @ 66 psi | D648 | deg F | 250 | 158 | 164 | 219 | 240 | 248 | 300 |
| HDT, @ 264 psi | D648 | deg F | 122 | 129 | 118 | 160 | 169 | - | 239 |

FIG. 3

400

401 403 405

| Environment | FKM | Fluoroplastics |
|---|---|---|
| Low temperature properties | Good down to -30°C | Excellent down to -200°C |
| High temperature properties | Good up to 200°C | Excellent up to 250°C |
| Resistance to $H_2S$ | Moderate | Excellent |
| Acid Resistance | Moderate | Excellent |
| High pH fluid resistance | Poor | Excellent |
| Resistance to Formate | Poor | Excellent |
| High Temp Steam Exposure | Poor | Excellent |
| Oil Resistance | Excellent | Excellent |
| Cost to Performance Ratio | Moderate | Good |

FIG. 4

FLUOROPLASTIC EXPANDABLE LINER HANGER ELEMENTS FOR GEOTHERMAL AND CORROSIVE ENVIRONMENTS

TECHNICAL FIELD

The disclosure generally relates to downhole tools for use in a wellbore formed in one or more subsurface formations, and in particular, chemical and temperature resistant elements of an expandable liner hanger system.

BACKGROUND

Liner hanger systems may be used in subsurface wells to extend a liner from the bottom of a cemented casing string. Traditional expandable liner hangers may use elastomeric elements in their construction. For example, an elastomeric element may be used between the anchoring spikes designed into the metallic body of the liner hanger. The elastomeric element may include an elastomeric ring positioned circumferentially around the liner hanger body, the elastomeric ring configured to form a fluidic seal and to provide mechanical support to the anchoring spikes. The elastomeric elements traditionally make contact with an internal surface of a downhole casing via expansion. The expansion may be performed by an expansion cone traveling through an interior of the expandable liner.

Hydrogenated nitrile (HNBR) and fluorocarbon (FKM) elastomers may be used as the elastomeric element bonded to the outer diameter of the hanger bodies. However, both materials may suffer chemical degradation in certain well environments such as those with extreme temperatures, high hydrogen sulfide ($H_2S$) concentrations, high pH exposures, etc. Other materials may grant enhanced durability to the liner hanger systems, but at a cost that may be prohibitive. For example, perfluorocarbon (FFKM) may be a more chemically stable material than traditional elastomers, but the cost increase of using FFKM seals may be undesirable in most situations. Therefore, it may be advantageous to enhance the durability of liner hanger systems by using seals comprised of materials that are both robust and cost effective.

BRIEF DESCRIPTION OF THE DRAWINGS

Implementations of the disclosure may be better understood by referencing the accompanying drawings.

FIG. 3 is a table depicting mechanical properties of fluoropolymers, according to some implementations.

FIG. 4 is a table depicting a performance comparison of FKM and fluoroplastics, according to some implementations.

FIGS. 1-5 and the operations described herein are examples meant to aid in understanding example implementations and should not be used to limit the potential implementations or limit the scope of the claims. None of the implementations described herein may be performed exclusively in the human mind nor exclusively using pencil and paper. None of the implementations described herein may be performed without computerized components such as those described herein. Some implementations may perform additional operations, fewer operations, operations in parallel or in a different order, and some operations differently.

DESCRIPTION OF SOME EXAMPLE IMPLEMENTATIONS

The description that follows includes example systems, methods, techniques, and program flows that embody implementations of the disclosure. However, it is understood that this disclosure may be practiced without these specific details. In other instances, well-known instruction instances, protocols, structures, and techniques have not been shown in detail in order not to obfuscate the description.

Overview

To increase the durability of traditional liner hanger systems in corrosive and/or high-temperature wellbore environments, high-temperature and chemically resistant thermoplastic materials may be used as sealing elements in expandable liner hangers. More specifically, a heat and chemically resistant fluoroplastic may replace the traditional FKM and HNBR elastomeric sealing elements. This may solve downhole chemical compatibility concerns with the added benefit of increased damage tolerance over traditional elastomers at only a nominal increase in cost.

Example Expandable Liner Hanger System

Figure 1:
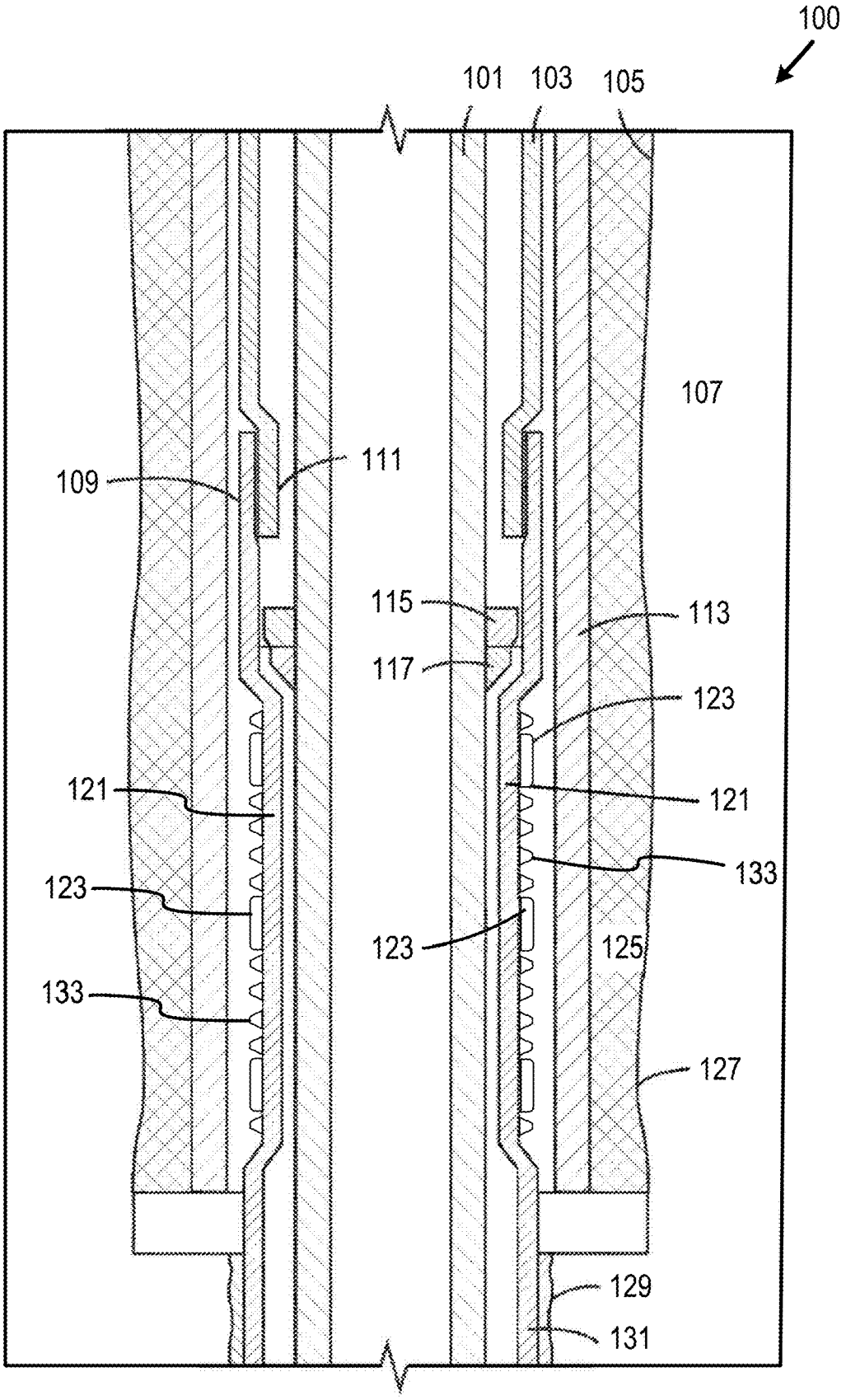
FIG. 1 is a longitudinal section diagram depicting an example expandable liner hanger system, according to some implementations.

An example expandable liner hanger is now described. FIG. 1 is a longitudinal section 100 diagram depicting an example expandable liner hanger system, according to some implementations. A wellbore 105 may be drilled through a subsurface formation 107. The wellbore 105 may be at least partially cased by a casing 113 that defines a cased section 127. The casing 113 may be cemented in the wellbore 105 by cement 125. A lower section 129 of the wellbore 105 may include a liner 131 and a tubing string 101 that extend into the lower section 129. The liner 131 may hang from a lower end of the casing 113 via an expandable liner hanger 121.

The expandable liner hanger 121 may include a plurality of anchoring spikes 133 and one or more sealing elements 123 positioned circumferentially around an exterior of the expandable liner hanger 121. Some implementations of the expandable liner hanger 121 may include a differing quantity of anchoring spikes 133 and sealing elements 123 than depicted in FIG. 1. An upper portion of the expandable liner hanger 121 may be joined to a tie back receptacle 103 via a threaded joint 109. The expandable liner hanger 121 may include a larger inner diameter than an outer diameter of a tapered section 111 of the tie back receptacle 103. However, other implementations may use a different means of coupling the expandable liner hanger 121 and tie back receptacle 103 than the threaded joint 109.

The expandable liner hanger 121 may be expanded to sealingly engage with the casing 113 via expansion cones 115 and 117 to create an interference fit with the casing 113. The expansion cones 115, 117 may be conveyed into the wellbore 105 via the tubing string 101. Fluidic pressure applied from the surface may push the expansion cones 115, 117 through the expandable liner hanger 121. This may expand the outer diameter of the expandable liner hanger 121, and the anchoring spikes 133 and sealing elements 123 may contact the inner wall of the casing 113 to form the seal. In some implementations, the one or more sealing elements 123 may include an exterior sealing surface configured to contact the casing 113. The sealing elements 123 may be constructed with a dense, closed surface geometry in order to form the seal. However, some implementations of the sealing elements 123 may be constructed of other geometries (e.g., a lattice structure).

The anchoring spikes 133 may be metallic anchoring spikes comprised of one or more metals, alloys, etc. For example, the anchoring spikes 133 may be comprised of any suitable steel grade, aluminum, any other ductile material, any combination thereof, etc. Each anchoring spike 133 may be a circular ring that positioned circumferentially around an outer diameter of the expandable liner hanger 121, although other configurations, spacings, quantities, and surface geometries of the anchoring spikes 133 may be possible. Each of the anchoring spikes 133 may provide a metal-to-metal seal between the expandable liner hanger 121 and an inner surface of the casing 113.

Additional sealing capability may be achieved by the sealing elements 123. The seal formed with the casing 113 may be a fluidic seal, a pressure seal, a mechanical seal, etc. One or more sealing elements 123 may be placed between a section of the anchoring spikes 133 to form the seal, increase the anchoring load of the expandable liner hanger 121, provide pressure integrity to the seal between the expandable liner hanger 121 and the casing 113, etc.

Each of the sealing elements 123 may be comprised of a thermoplastic material configured for use in high-temperature, high-pressure (HTHP) environments. For example, the sealing elements 123 may be comprised of one or more fluoroplastics including Polytetrafluoroethylene (PTFE), Fluorinated ethylene propylene (FEP), perfluoro alkoxy (PFA), Ethylene tetrafluoroethylene (ETFE), ethylene-chlorotrifluoroethylene (ECTFE), polychlorotrifluoroethylene (PCTFE), polyvinylidene fluoride (PVDF), etc. In some implementations, other fluoroplastics and/or other non-fluoroplastic fluoropolymers may also be used. The above-described fluoroplastics may have a high resistance to chemicals and solvents, very high electrical resistance, and may remain chemically stable in in both very low and very high working temperatures. For example, the volume resistivity of PVDF is approximately $1\times10^{14}$ ohm/cm, the volume resistivity of FEP is approximately $1\times10^{18}$ ohm/cm, and the volume resistivity of PTFE is $\sim10^{18}$-$10^{19}$ ohm/cm. Regarding working temperatures, the above-listed fluoroplastics may have an average example operating temperature range from −200° C. up to 260° C. This temperature range may allow the sealing elements 123, and by extension, the expandable liner hanger 121, to be used in service conditions where extreme low temperature performance is required, such as in carbon capture applications. Fluoroplastic sealing elements may also enable the expandable liner hanger 121 to be used in service conditions where extreme high temperature performance is required, such as in geothermal applications.

Fluoroplastic sealing elements provide exceptional chemical and/or corrosion resistance. For example, a sealing element comprised of one of the above fluoroplastics may be configured to operate in any concentration of $H_2S$ without degradation when compared to traditional elastomeric seals. Fluoroplastic sealing elements may also offer increased corrosion resistance against other downhole corrosive elements (other than $H_2S$) than the elastomeric compounds used in traditional sealing elements. For example, the sealing elements 123 comprised of at least one of the described fluoroplastics may be used in applications having high pH fluids, formate brines, high $H_2S$ concentrations, and most other downhole exposures where traditional elastomer sealing elements, such as those comprised of FKM, may face chemical compatibility challenges, degradation, other adverse effects, and eventual failure. Formate brines may have a pH level greater than 8, and long-term exposure to alkaline fluids may degrade traditional elastomeric sealing elements.

The above-described fluoropolymers may be thermoplastics. However, other implementations of the sealing elements 123 may use non-fluoropolymer-based thermoplastics or thermosetting plastics including polyethylene, polypropylene, nylon, phenolic, epoxy, etc. depending on an expected temperature and other environmental conditions (e.g., $H_2S$ concentration) of the wellbore 105 where the expandable liner hanger 121 is to be set. The corrosion and thermal resistance of the non-fluoropolymer sealing elements may be far lower than sealing elements comprised of the above-described thermoplastic fluoropolymers.

Figure 2:
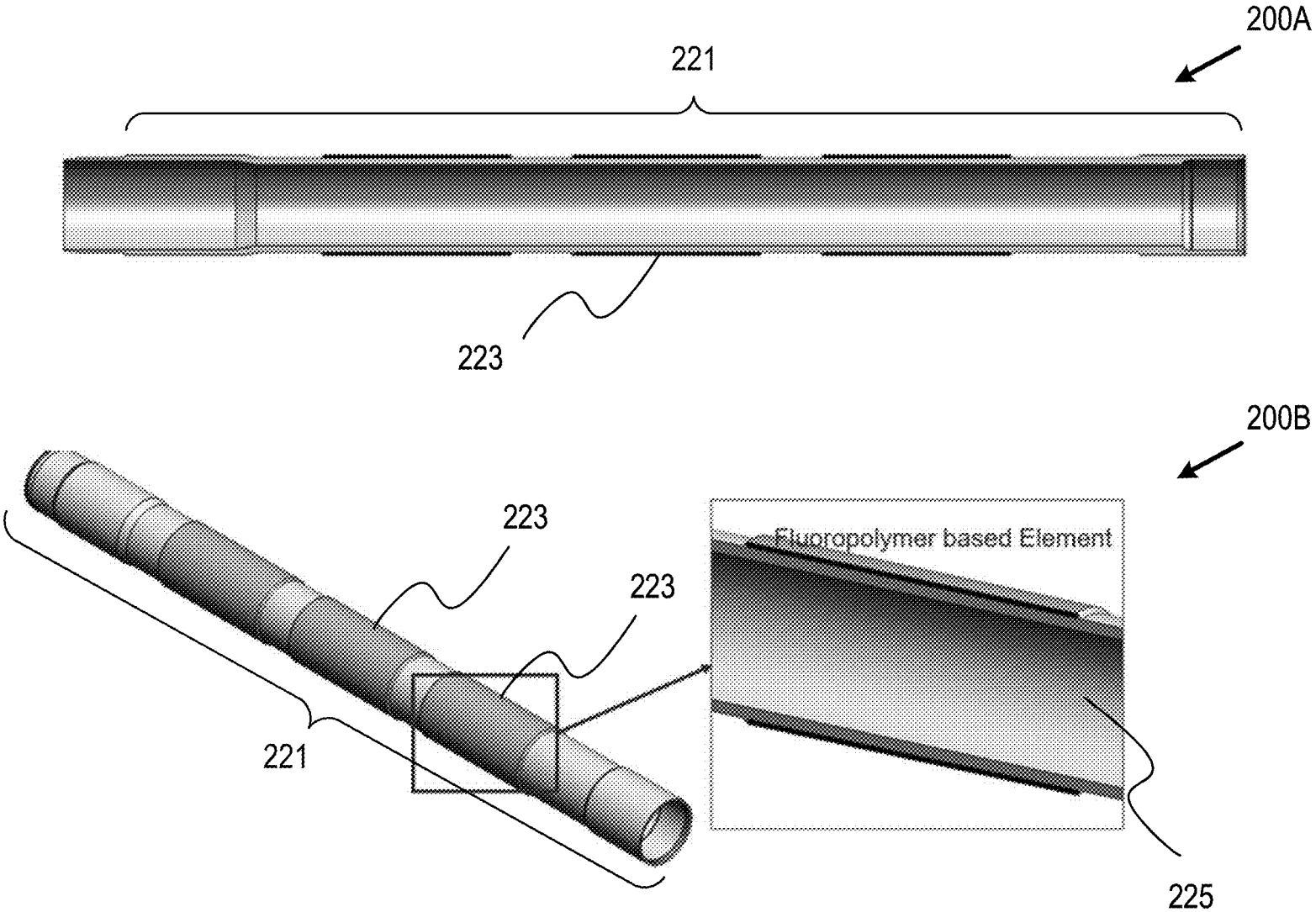
FIG. 2 includes a longitudinal section and a schematic diagram of an example expandable liner hanger, according to some implementations.

FIG. 2 includes a longitudinal section 200A and a schematic diagram 200B of an example expandable liner hanger, according to some implementations. The longitudinal section 200A includes an expandable liner hanger 221 which may be similar to the expandable liner hanger 121 of FIG. 1. The expandable liner hanger 221 may include one or more fluoroplastic sealing elements 223 which may be similar to the sealing elements 123 of FIG. 1. The fluoroplastic sealing elements 223 may form a primary seal with an inner surface of a casing string. Some implementations of the expandable liner hanger may use anchoring spikes, such as the expandable liner hanger 121. However, other implementations of the expandable liner hanger, such as the expandable liner hanger 221, may be configured to radially expand and form a seal without the use of anchoring spikes. In some implementations, each of the fluoroplastic sealing elements 223 may include one or more grooves on an exterior sealing surface. The grooves may allow a downhole fluid to move through the grooves and off of the exterior sealing surface of the sealing elements 223 when forming the seal with the casing.

The schematic diagram 200B includes multiple fluoroplastic sealing elements 223. The fluoroplastic sealing elements 223 may be one or more rings circumferentially bonded around the exterior of the expandable liner hanger 121. To engage the fluoroplastic sealing elements 223, expansion elements such as the expansion cones 115, 117 of FIG. 1 may expand at least a portion of the expandable liner hanger 221 to contact an interior surface of a tubular (e.g., the casing 113). The fluoroplastic sealing elements 223 may then form one or more seals once the expandable liner hanger 221 has expanded. As depicted, the fluoroplastic sealing elements 223 may be rings bonded to the exterior of the expandable liner hanger 221. However, other configurations may be possible.

Example Tables

FIG. 3 is a table 300 depicting the mechanical properties of various fluoropolymers, according to some implementations. The table 300 includes properties of fluoropolymers such as specific gravity, melting point, various mechanical strengths, and heat deflection temperatures (HDT) at various pressures. Units are also included for each property where applicable. Also included are method numbers for the tests, performed by ASTM International, used to determine the property values of the various fluoropolymers. The various fluoropolymers may include fluoroplastics such as PTFE, FEP, PFA, ETFE, ECTFE, PCTFE, and PVDF. These fluoroplastics may be selected for use in the one or more sealing elements 123.

The fluoroplastics depicted in table 300 are engineering plastics with high strength, chemical resistance, and extreme service temperature capabilities. The fluoroplastics of the table 300 may include both filled and unfilled grades. Fluoroplastics may be chemically compatible with most downhole chemistries including both ends of the pH scale and any level of $H_2S$ contamination in the well. Fluoroplastics may present a more robust design option during run-in into the wellbore 105 and may be less sensitive to damage when encountering debris. Service temperatures of the fluoroplastics may offer an expanded operating envelope of −200° C. up to 250° C., on average. For example, while PVDF has a melting point of 177° C. (as shown in the table 300), PTFE may have a melting point of 327° C. Other fluoroplastics with other operating temperature ranges may also be used. A fluoroplastic for use in the one or more sealing elements 123 may be selected based on expected downhole conditions and expected operations to be performed. For example, one fluoroplastic may perform better in the colder conditions observed in carbon capture/injection, whereas a different fluoroplastic may excel in high-heat operations such as those encountered in geothermal wells.

FIG. 4 is a table 400 depicting a performance comparison between FKM and various fluoroplastics, according to some implementations. The fluoroplastics described in the table 400 may include PTFE, FEP, PFA, ETFE, ECTFE, PCTFE, and PVDF, although other fluoroplastics may be used. The table 400 includes an environment column 401, a FKM column 403, and a fluoroplastic column 405. FKM, a fluoroelastomer, generally possesses less environmental resistance than fluoroplastics on average. Fluoroplastics excel in high heat applications, low temperature applications, high $H_2S$ environments, and are more chemically resistant against acids, high pH fluids, formate, and oil than FKM. As seen in the table 400, fluoroplastics offer increased performance for downhole seals with an advantageous cost to performance ratio, on average.

Replacing the materials of traditional sealing elements with fluoroplastics may help to improve the overall chemical resistance and service temperatures of the expandable liner hanger 121. FKM elastomers are susceptible to chemical attack by high pH fluids (above a pH of 8) like formate brines, with properties showing degradation over long exposure durations. FKM also possesses a lower tolerance to high $H_2S$ concentrations, based on expected service temperatures, than the above-described fluoroplastics. For example, FKM sealing elements may be limited for use in a maximum hydrogen sulfide concentration of approximately 5% for long term service applications, whereas fluoroplastics may perform in any $H_2S$ concentration. FKM is recommended for temperature applications ranging from −30° C. to 200° C., which limits its use in cases of extreme temperature applications. Carbon capture and geothermal applications, for example, may include temperature conditions ranging from −100° C. up to 250° C., respectively. Therefore, sealing elements formed from fluoroplastics may excel in environments where traditional sealing elements struggle.

Example Method

Figure 5:
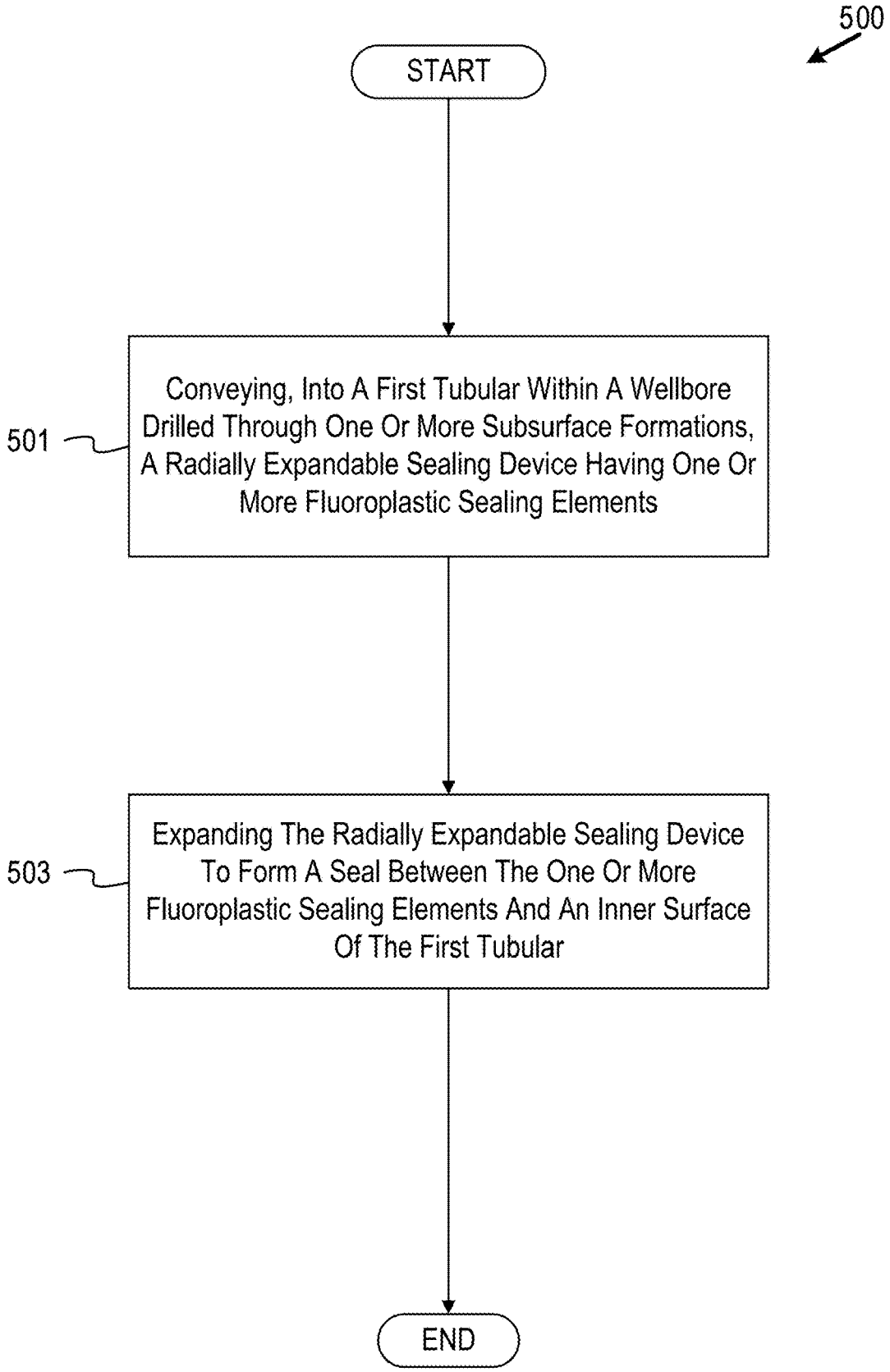
FIG. 5 is a flowchart depicting an example method of operations, according to some implementations.

FIG. 5 is a flowchart depicting an example method of operations, according to some implementations. Operations of a method 500 may be performed in part by software, firmware, hardware, or a combination thereof. Such operations are described with reference to FIGS. 1-4. However, such operations may be performed by other systems or components. The operations of the method 500 begin at block 501.

At block 501, the method 500 includes conveying, into a first tubular within the wellbore drilled through one or more subsurface formations, a radially expandable sealing device having one or more fluoroplastic sealing elements. For example, a radially expandable sealing device such as the expandable liner hanger 121 may be conveyed into the wellbore 105 and through the casing 113. The expandable liner hanger 121 may include one or more sealing elements 123 comprised of a fluoroplastic material. Fluoroplastic sealing elements may enable the expandable liner hanger 121 to operate in a wider range of downhole environments. For example, operations in low-temperature injection wells (e.g., $CO_2$ injection wells) and operations in high-temperature geothermal wells may be performed using fluoroplastic sealing elements where traditional elastomeric sealing elements may fail. Flow progresses to block 503.

At block 503, the method 500 includes expanding the radially expandable sealing device to form a seal between the one or more fluoroplastic sealing elements and an inner surface of the first tubular. For example, the expandable liner hanger 121 may be expanded by at least one of the expansion cones 115, 117. The expansion cone(s) may travel through an interior of the expandable liner hanger 121, increasing its diameter. Once expanded, the anchoring spikes 133 and sealing elements 123 (comprised of a fluoroplastic material) on the exterior of the expandable liner hanger 121 may form a seal with an inner surface of the casing 113. The expansion of the radially expandable sealing device may be induced by one or more personnel at the surface of the wellbore 105, autonomously via a computer and one or more pumps, or by any other suitable means. Flow of the method 500 ceases.

Example Implementations

Implementation 1: A system comprising: a radially expandable sealing device positioned in a wellbore proximate to a subsurface formation; and one or more fluoroplastic sealing elements positioned on an exterior of the radially expandable sealing device.

Implementation 2: The system of Implementation 1, further comprising: a casing string positioned in the wellbore; and a plurality of anchoring spikes positioned circumferentially along the exterior of the radially expandable sealing device, wherein the one or more fluoroplastic sealing elements and the plurality of anchoring spikes are configured to form a seal with an inner surface of the casing string.

Implementation 3: The system of any one or more of Implementations 1-2, wherein the radially expandable sealing device is configured to radially expand to form the seal.

Implementation 4: The system of any one or more of Implementations 1-3, wherein the one or more fluoroplastic sealing elements are comprised of a thermoplastic material.

Implementation 5: The system of any one or more of Implementations 1-4, wherein each of the one or more fluoroplastic sealing elements include at least one of Polytetrafluoroethylene (PTFE), Fluorinated ethylene propylene (FEP), perfluoro alkoxy (PFA), Ethylene tetrafluoroethylene (ETFE), ethylene-chlorotrifluoroethylene (ECTFE), polychlorotrifluoroethylene (PCTFE), and polyvinylidene fluoride (PVDF).

Implementation 6: The system of any one or more of Implementations 1-5, wherein the one or more fluoroplastic sealing elements are rings positioned circumferentially around the exterior of the radially expandable sealing device.

Implementation 7: The system of any one or more of Implementations 1-6, wherein the system further includes one or more sealing elements comprised of at least one of a non-fluoropolymer-based thermoplastic and a non-fluoropolymer-based thermosetting plastic, wherein the non-fluoropolymer-based thermoplastic and the non-fluoropolymer-based thermosetting plastic include at least one of polyethylene, polypropylene, nylon, phenolic, and epoxy.

Implementation 8: The system of any one or more of Implementations 1-7, wherein each of the one or more fluoroplastic sealing elements includes a plurality of grooves, wherein the plurality of grooves is configured to move a fluid from a sealing surface of each sealing element.

Implementation 9: An apparatus comprising: one or more fluoroplastic sealing elements configured for use on an exterior of a radially expandable sealing device, the radially expandable sealing device to be positioned in a wellbore proximate to a subsurface formation.

Implementation 10: The apparatus of Implementation 9, wherein the one or more fluoroplastic sealing elements are comprised of a thermoplastic material.

Implementation 11: The apparatus of any one or more of Implementations 9-10, wherein each of the one or more fluoroplastic sealing elements include at least one of Polytetrafluoroethylene (PTFE), Fluorinated ethylene propylene (FEP), perfluoro alkoxy (PFA), Ethylene tetrafluoroethylene (ETFE), ethylene-chlorotrifluoroethylene (ECTFE), polychlorotrifluoroethylene (PCTFE), and polyvinylidene fluoride (PVDF).

Implementation 12: The apparatus of any one or more of Implementations 9-11, wherein the one or more fluoroplastic sealing elements are rings positioned circumferentially around the exterior of the radially expandable sealing device.

Implementation 13: The apparatus of any one or more of Implementations 9-12, wherein the one or more fluoroplastic sealing elements are configured to form a seal with at least a portion of a casing string positioned in the wellbore.

Implementation 14: The apparatus of any one or more of Implementations 9-13, further comprising: one or more sealing elements comprised of at least one of a non-fluoropolymer-based thermoplastic and a non-fluoropolymer-based thermosetting plastic, wherein the non-fluoropolymer-based thermoplastic and the non-fluoropolymer-based thermosetting plastic include at least one of polyethylene, polypropylene, nylon, phenolic, and epoxy.

Implementation 15: The apparatus of any one or more of Implementations 9-14, wherein each of the one or more fluoroplastic sealing elements includes a plurality of grooves, wherein the plurality of grooves is configured to move a fluid from a sealing surface of each sealing element.

Implementation 16: A method comprising: conveying, into a first tubular within a wellbore drilled through one or more subsurface formations, a radially expandable sealing device having one or more fluoroplastic sealing elements; and expanding the radially expandable sealing device to form a seal between the one or more fluoroplastic sealing elements and an inner surface of the first tubular.

Implementation 17: The method of Implementation 16, further comprising: forming the seal with the inner surface of the first tubular via the one or more fluoroplastic sealing elements and a plurality of anchoring spikes, wherein the one or more fluoroplastic sealing elements and the plurality of anchoring spikes are rings positioned circumferentially along an exterior of the radially expandable sealing device.

Implementation 18: The method of any one or more of Implementations 16-17, further comprising: radially expanding the radially expandable sealing device via at least one expansion cone configured to travel through an interior of the radially expandable sealing device.

Implementation 19: The method of any one or more of Implementations 16-18, further comprising: performing an operation in an injection well using the radially expandable sealing device having the one or more fluoroplastic sealing elements.

Implementation 20: The method of any one or more of Implementations 16-19, further comprising: performing an operation in a geothermal well using the radially expandable sealing device having the one or more fluoroplastic sealing elements.

Various modifications to the implementations described in this disclosure may be readily apparent to those skilled in the art, and the generic principles defined herein may be applied to other implementations without departing from the spirit or scope of this disclosure. Thus, the claims are not intended to be limited to the implementations shown herein but are to be accorded the widest scope consistent with this disclosure, the principles and the novel features disclosed herein.

Certain features that are described in this specification in the context of separate implementations also may be implemented in combination in a single implementation. Conversely, various features that are described in the context of a single implementation also may be implemented in multiple implementations separately or in any suitable sub-combination. Moreover, although features may be described as acting in certain combinations and even initially claimed as such, one or more features from a claimed combination may in some cases be excised from the combination, and the claimed combination may be directed to a sub-combination or variation of a sub-combination.

While operations are depicted in the drawings in a particular order, this should not be understood as requiring that such operations be performed in the particular order shown or in sequential order, or that all illustrated operations be performed, to achieve desirable results. Further, the drawings may schematically depict one more example process in the form of a flow diagram. However, some operations may be omitted and/or other operations that are not depicted may be incorporated in the example processes that are schematically illustrated. For example, one or more additional operations may be performed before, after, simultaneously, or between any of the illustrated operations. In certain circumstances, multitasking and parallel processing may be advantageous. Moreover, the separation of various system components in the implementations described should not be understood as requiring such separation in all implementations, and the described program components and systems may generally be integrated together in a single software product or packaged into multiple software products. Additionally, other implementations are within the scope of the following claims. In some cases, the actions recited in the claims may be performed in a different order and still achieve desirable results.

Use of the phrase "at least one of" preceding a list with the conjunction "and" should not be treated as an exclusive list and should not be construed as a list of categories with one item from each category, unless specifically stated otherwise. A clause that recites "at least one of A, B, and C" may be infringed with only one of the listed items, multiple of the listed items, and one or more of the items in the list and another item not listed. As used herein, a phrase referring to "at least one of" a list of items refers to any combination of those items, including single members. As an example, "at least one of: a, b, or c" is intended to cover: a, b, c, a-b, a-c, b-c, and a-b-c.

As used herein, the term "or" is inclusive unless otherwise explicitly noted. Thus, the phrase "at least one of A, B, or C" is satisfied by any element from the set {A, B, C} or any combination thereof, including multiples of any element.

What is claimed is:

1. A system comprising:

a radially expandable liner hanger to be positioned in a wellbore proximate to a subsurface formation, the radially expandable liner hanger including, one or more fluoroplastic sealing elements positioned on an exterior of the radially expandable liner hanger, wherein each of the one or more fluoroplastic sealing elements are comprised of at least one of fluorinated ethylene propylene (FEP), perfluoro alkoxy (PFA), ethylene tetrafluoroethylene (ETFE), ethylene-chlorotrifluoroethylene (ECTFE), polychlorotrifluoroethylene (PCTFE), or polyvinylidene fluoride (PVDF).

2. The system of claim 1, further comprising:

a plurality of anchoring spikes positioned circumferentially along the exterior of the radially expandable liner hanger, and wherein the one or more fluoroplastic sealing elements and the plurality of anchoring spikes are configured to form a seal with an inner surface of a casing string.

3. The system of claim 2, wherein the radially expandable liner hanger is configured to radially expand to form the seal.

4. The system of claim 1, wherein the one or more fluoroplastic sealing elements are comprised of a thermoplastic material.

5. The system of claim 1, wherein the one or more fluoroplastic sealing elements are rings positioned circumferentially around the exterior of the radially expandable liner hanger.

6. The system of claim 1, wherein the system further includes one or more sealing elements comprised of at least one of a non-fluoropolymer-based thermoplastic and a non-fluoropolymer-based thermosetting plastic, wherein the non-fluoropolymer-based thermoplastic and the non-fluoropolymer-based thermosetting plastic include at least one of polyethylene, polypropylene, nylon, phenolic, or an epoxy.

7. The system of claim 1, wherein each of the one or more fluoroplastic sealing elements includes a plurality of grooves, wherein the plurality of grooves is configured to move a fluid from a sealing surface of each sealing element.

8. The system of claim 1, wherein at least one of the one or more fluoroplastic sealing elements are comprised of polytetrafluoroethylene (PTFE).

9. An apparatus comprising:

one or more fluoroplastic sealing elements configured for use on an exterior of a radially expandable liner hanger, the radially expandable liner hanger to be positioned in a wellbore proximate to a subsurface formation, wherein each of the one or more fluoroplastic sealing elements are comprised of at least one of fluorinated ethylene propylene (FEP), perfluoro alkoxy (PFA), ethylene tetrafluoroethylene (ETFE), ethylene-chlorotrifluoroethylene (ECTFE), polychlorotrifluoroethylene (PCTFE), or polyvinylidene fluoride (PVDF).

10. The apparatus of claim 9, wherein the one or more fluoroplastic sealing elements are comprised of a thermoplastic material.

11. The apparatus of claim 9, wherein the one or more fluoroplastic sealing elements are rings positioned circumferentially around the exterior of the radially expandable liner hanger.

12. The apparatus of claim 9, wherein the one or more fluoroplastic sealing elements are configured to form a seal with at least a portion of a casing string positioned in the wellbore.

13. The apparatus of claim 9, further comprising:

one or more sealing elements comprised of at least one of a non-fluoropolymer-based thermoplastic and a non-fluoropolymer-based thermosetting plastic, wherein the non-fluoropolymer-based thermoplastic and the non-fluoropolymer-based thermosetting plastic include at least one of polyethylene, polypropylene, nylon, phenolic, or an epoxy.

14. The apparatus of claim 9, wherein each of the one or more fluoroplastic sealing elements includes a plurality of grooves, wherein the plurality of grooves is configured to move a fluid from a sealing surface of each sealing element.

15. The apparatus of claim 9, wherein at least one of the one or more fluoroplastic sealing elements are comprised of polytetrafluoroethylene (PTFE).

16. A method comprising:

forming a radially expandable liner hanger including one or more fluoroplastic sealing elements positioned on an exterior of the radially expandable liner hanger, wherein each of the one or more fluoroplastic sealing elements are comprised of at least one of fluorinated ethylene propylene (FEP), perfluoro alkoxy (PFA), ethylene tetrafluoroethylene (ETFE), ethylene-chlorotrifluoroethylene (ECTFE), polychlorotrifluoroethylene (PCTFE), or polyvinylidene fluoride (PVDF).

17. The method of claim 16, further comprising:

forming a seal with an inner surface of a first tubular via the one or more fluoroplastic sealing elements and a plurality of anchoring spikes, wherein the one or more fluoroplastic sealing elements and the plurality of anchoring spikes include one or more rings positioned circumferentially along the exterior of the radially expandable liner hanger.

18. The method of claim 16, further comprising:

conveying, into a first tubular positioned within a wellbore drilled through one or more subsurface formations, the radially expandable liner hanger; and radially expanding the radially expandable liner hanger via at least one expansion cone configured to travel through an interior of the radially expandable liner hanger, wherein at least one of the one or more fluoroplastic sealing elements are comprised of polytetrafluoroethylene (PTFE).

19. The method of claim 16, further comprising:

performing an operation in an injection well using the radially expandable liner hanger including the one or more fluoroplastic sealing elements.

20. The method of claim 16, further comprising:

performing an operation in a geothermal well using the radially expandable liner hanger including the one or more fluoroplastic sealing elements.

* * * * *